US007059260B1

(12) United States Patent
Quartarone

(10) Patent No.: US 7,059,260 B1
(45) Date of Patent: Jun. 13, 2006

(54) STEERING CONTROL BY MEANS OF SELECTED SEGMENTED DRAG REDUCTION

(75) Inventor: James R. Quartarone, Loveland, CO (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 73 days.

(21) Appl. No.: 11/217,841

(22) Filed: Aug. 26, 2005

(51) Int. Cl.
*B63B 1/38* (2006.01)

(52) U.S. Cl. ..... 114/67 A; 114/330

(58) Field of Classification Search ..... 114/67 RA, 114/330

See application file for complete search history.

(56) References Cited

U.S. PATENT DOCUMENTS 2,969,759 A 1/1961 Giles
3,096,739 A 7/1963 Smith
3,382,832 A 5/1968 Swanson
3,392,693 A * 7/1968 Hulsebos et al. ..... 114/20.1
3,435,796 A * 4/1969 Merrill ..... 114/67 R
3,604,661 A 9/1971 Mayer, Jr.
3,628,488 A 12/1971 Gibson
4,186,679 A 2/1980 Fabula et al.
4,987,844 A * 1/1991 Nadolink ..... 114/20.1
5,603,278 A * 2/1997 Nedderman et al. ..... 114/67 R

* cited by examiner

*Primary Examiner*—Jesus D. Sotelo
(74) *Attorney, Agent, or Firm*—Michael P. Stanley; James M. Kasischke; Jean Paul A. Nasser

(57) ABSTRACT

A steering system is provided for a hydrodynamically shaped vehicle having a nose end, a tail end, and forward propulsion. The steering system includes an internal supply of drag-reducing medium, at least one ejector ring positioned adjacent a nose end of the vehicle, and a plurality of ejector sections formed in the at least one ejector ring. Each ejector section includes an opening arrangement for ejecting drag-reducing medium to an external surface of the vehicle. A control unit selectively supplies drag-reducing medium to at least one of the plurality of ejector sections. The drag-reducing medium ejected from selected ejector sections causes a reduced-drag surface on said vehicle body and an increased speed thereof relative to a remainder of the vehicle body and thereby imparting a directional motion to the vehicle in the form of pitch and/or yaw.

14 Claims, 7 Drawing Sheets

STEERING CONTROL BY MEANS OF SELECTED SEGMENTED DRAG REDUCTION

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

1. Field of the Invention

This invention generally relates to a reduced drag steering device. More particularly, the invention relates to a steering device for an underwater vehicle that uses a selectively ejected drag reducing medium to steer the vehicle.

2. Description of the Prior Art

The current art for steering underwater vehicles is by means of rudders or other similar protruding mechanisms. In the case of many underwater vehicles, there is a need for a more streamlined approach to steering. In particular, torpedoes need compact steering mechanisms in order to fit inside of torpedo tubes. Other craft require compact steering mechanisms to run at shallow depths, or to reduce the chance of fouling. Further, torpedoes, submarines, and other vehicles require smooth streamlined steering mechanisms to reduce drag and noise.

The following patents, for example, disclose drag reducing methods or underwater steering, but do not disclose the use of a selectively ejected drag reducing medium to control steering of an underwater vehicle.

U.S. Pat. No. 2,969,759 to Giles;
U.S. Pat. No. 3,096,739 to Smith;
U.S. Pat. No. 3,382,739 to Swanson;
U.S. Pat. No. 3,604,661 to Mayer, Jr.;
U.S. Pat. No. 3,628,488 to Gibson; and
U.S. Pat. No. 4,186,679 to Fabula et al.

Specifically, Giles discloses hydrodynamic drag reduction in vehicles through boundary layer control. The device includes a plurality of slit means integral with the surface of the vehicle to permit a suction flow, duct means operatively associated with the slit means for carrying the suction flow to the stern of the vehicle, pump means operatively coupled to the duct means for generating and maintaining the suction flow and for preventing any hindrance to the suction flow at the surface of the vehicle, and means for reversing the suction flow.

The patent to Smith discloses a method and apparatus for steering underwater bodies of the type having a surface adjacent which water is adapted to flow and produce hydrodynamic force lateral to the direction of movement of the body and includes the steps of delivering a gas in a quantity insufficient to produce a jet reaction steering force but in a quantity sufficient for flow adjacent the surface to spoil the water flow and produce a different lateral hydrodynamic force on the body.

Swanson discloses a torpedo drag reduction apparatus. Sheets of an ablative and water soluble material containing a drag reducing polymer agent are mounted on a labyrinth of baffles in an annular cavity underneath the nose fairing of a torpedo. Ambient seawater, under ram pressure, is ingested by scoops and introduced into the rear end of the chamber. As the seawater circulates through the baffle labyrinth it dissolves the polymer agent contained in the ablative sheets. The front end of the annular chamber is communicated with the exterior of the surface of the torpedo hull by a circumferential slot which extends continuously about the torpedo. The solution of seawater and polymer, resulting from the circulation of the water through the labyrinth, issues forth through the slot into the boundary layer flow under the ram pressure.

Mayer, Jr. discloses a vehicle movable through a fluid-supporting medium and includes an active system for controlling the layer of fluid over at least a portion of the vehicle exterior surface. Parallel slots through the surface permit fluid under pressure to issue over the surface to reduce drag and improve lift and/or propulsion.

The patent to Gibson discloses an elongated flexible strip incorporating a longitudinally extending central tube provided with egress openings and is wrapped about the hull portion of a boat adjacent its bow. A chemical is fed into the central tube and passes out in controlled quantities from the egress openings to thereby form with water passing by the hull a diluted solution which then passes down the length of the hull and thereby reduces the friction of the boat hull when passing through water.

Fabula, et al. disclose a method and apparatus for reducing torpedo drag in which polymer drag reducing material is carried by the torpedo in concentrated form, ambient water is ingested and mixed with the concentrated polymer to produce a seawater-polymer solution of predetermined concentration, and the solution is ejected from the torpedo nose to be swept rearward in intimate contact with the exterior surface of the torpedo under torpedo forward motion.

It should be understood that the present invention would in fact enhance the functionality of the above patents by providing a steering mechanism for an underwater vehicle, in which the steering mechanism includes the selective ejection of a drag reducing polymer from a periphery of the vehicle.

SUMMARY OF THE INVENTION

Therefore it is an object of this invention to provide an improved steering system for an underwater vehicle.

Another object of this invention is to provide a steering system for an underwater vehicle using a drag reduction medium.

Still another object of this invention is to provide a steering system for an underwater vehicle using selectively ejected drag reduction medium for initiating movement in predetermined directions.

A further object of the invention is to provide a steering system for an underwater vehicle which eliminates conventional steering mechanisms.

An additional object of this invention is to provide a steering system for an underwater vehicle which supplements conventional steering mechanisms (e.g., torpedo's small control surfaces).

In accordance with one aspect of this invention, there is provided a steering system for a hydrodynamically shaped vehicle having a nose end, a tail end, and forward propulsion. The steering system includes an internal supply of drag reducing medium, at least one ejector ring positioned adjacent a nose end of the vehicle, and a plurality of ejector sections formed in the at least one ejector ring. Each ejector section includes an opening arrangement for ejecting drag-reducing medium to an external surface of the vehicle. A control unit selectively supplies and modulates drag-reducing medium to at least one of the plurality of ejector sections. The drag-reducing medium ejected from selected ejector sections causes a reduced drag surface on said vehicle body and an increased speed thereof relative to a remainder of the vehicle body and thereby imparting a controlled uneven directional motion to the vehicle, producing steering and trim control in the pitch and yaw directions.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF THE PREFERRED EMBODIMENT

Figure 1:
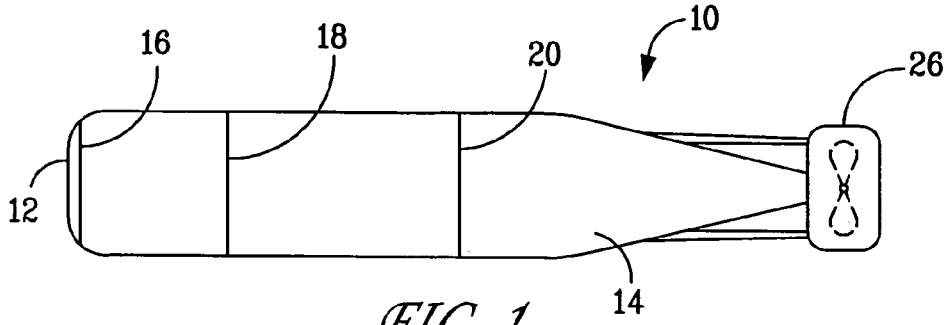
FIG. 1 is an underwater vehicle of a first streamlined shape showing locations of ejection slots according to a preferred embodiment of the present invention.
Figure 2:
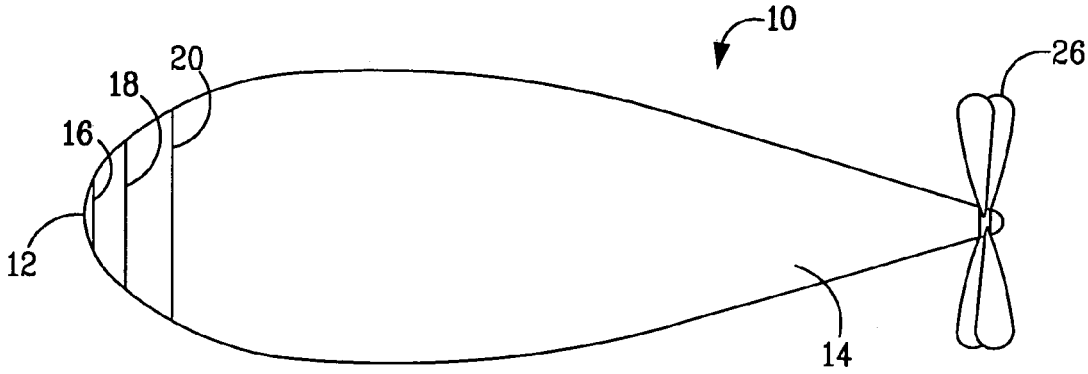
FIG. 2 is an underwater vehicle of an alternative streamlined shape showing locations of ejection slots according to the preferred embodiment of the present invention.

In general, the present invention is directed to a steering device applicable to an underwater vehicle 10 of the type shown by way of example in either of FIG. 1 or FIG. 2. The underwater vehicle 10 includes a nose end 12 and a tail end 14. In each instance, the underwater vehicle 10 will eject a drag-reducing medium 22, such as a drag-reducing polymer, from at least one of plural ejection rings, generally shown as 16, 18, and 20.

The vehicle 10 of FIG. 1 has a torpedo shaped body with an ejection ring 16 located adjacent the nose end 12 of the body, an ejection ring 20 located at an aft region of the body, and an ejection ring 18 located between the rings 16 and 20.

The vehicle 10 of FIG. 2 has a more streamlined shaped body and the ejection rings 16, 18, and 20 are shown more pronouncedly at the nose end 12 of the vehicle. The drag-reduction steering of the present invention is intended to be applicable to any vehicle body moving through the water, usually a submerged vehicle body, and the views of FIGS. 1 and 2 are exemplary only.

Each ejection ring 16, 18, 20 is simply a circumferential region on the vehicle body for ejection of the drag-reducing medium 22. The operating principle of the invention is the ejection of the drag-reducing medium 22 to effect a steering of the vehicle 10. In order to simplify the following disclosure, it will be assumed that drag-reducing medium is selectively ejected from an ejector section 24 around a circumference of the vehicle 10 and at any or all of the ejection ring locations 16, 18, 20.

Figure 3:
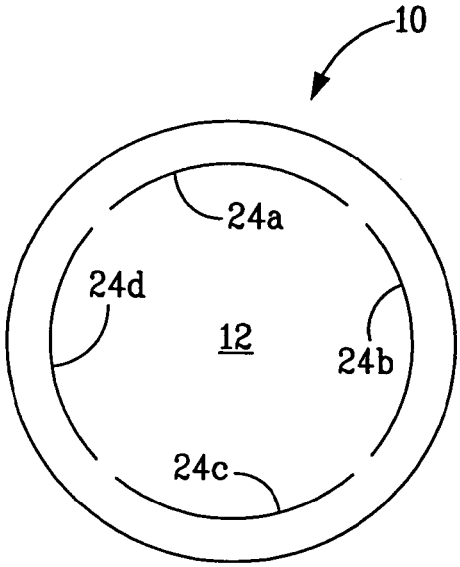
FIG. 3 is a front view of a vehicle nose with positioning of ejector slots in a first configuration.
Figure 4:
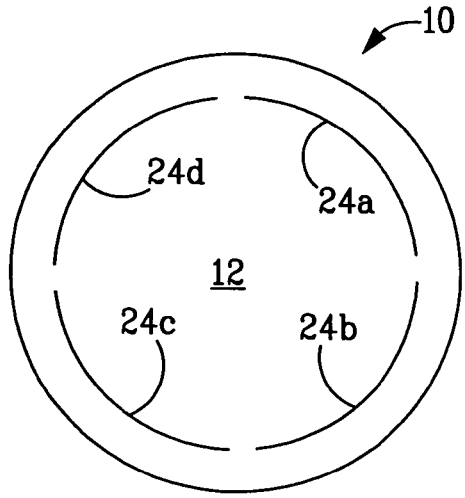
FIG. 4 is a front view of a vehicle nose with positioning of ejector slots in an alternative configuration.
Figure 5:
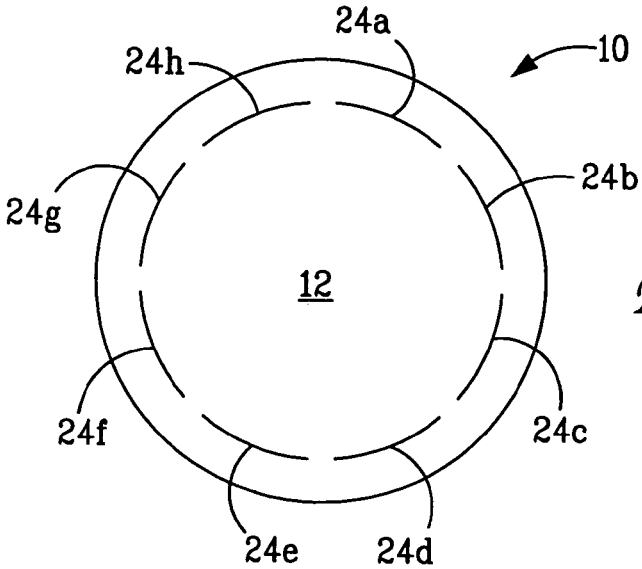
FIG. 5 is a front view of a vehicle nose with positioning of ejector slots in still another configuration.

The ejector sections 24 are selectively actuated to accomplish the intended steering and exemplary placements of the ejector sections is shown in FIGS. 3, 4, and 5. Each of FIGS. 3, 4, and 5 are viewed as facing vehicle 10 from the nose end 12 of vehicle 10. In FIG. 3 there are a total of four ejector sections 24 shown including the top 24*a*, port 24*b*, bottom 24*c*, and starboard 24*d*. In FIG. 4, the ejector sections 24 are nominally offset 45° as compared to the arrangement of FIG. 3. In FIG. 5, there are additional ejector sections 24*a* through 24*h* shown for increased maneuverability as will be explained.

Each ejector section 24 is the smallest entity that is controlled as far as selective ejection of the drag-reducing medium 22 is concerned. Each ejector section 24, when instructed, puts out a sheet, or quasi sheet, of a drag-reducing solution material 22 along a shaped surface of the vehicle body 10. The selected ejection ring 16, 18, 20 should optimally be far forward in the vehicle body to facilitate reduced drag steering. An ejection ring 16 farther forward toward the nose 12 of the vehicle will benefit the steering in at least two ways. First, more of the vehicle body 10 will receive the effects of the drag reduction fluid 22, by the fluid covering more of the desired regions of the body. Further, by being far forward, there will be more of a moment arm relative to the location of an aft thrusting mechanism 26. However, the ejection ring 16 should be at least a minimal distance back from the very nose 12 of the body 10 for practical reasons. Specifically, if the ring 16 were very near the front nose 12, a slight angle of attack of the torpedo could make the ejecting matter stream off to one side and not cover enough of the body 10. Further, there may be a need to place sonar, or even other devices, very close to the forward-most portion of the vehicle body 10, and placement of an ejector ring 16 may interfere with this equipment.

To maneuver the vehicle 10, selective ejection of the drag reducing medium 22 is controlled. For example, selective ejection of drag reducing medium 22 at the top regions of the vehicle will cause the vehicle to dive. Drag reduction material 22 on the top regions of the body 10 will mean the top has less resistance to forward movement. The top will increase in speed causing the vehicle 10 to dive, or more accurately, to curve in a diving direction. When the desired angle downward is achieved, the ejection process will be stopped or reduced. This can be better understood from a more detailed description of FIGS. 3, 4, and 5. In FIG. 3, fluid ejected from the top ejector section 24*a* will cause the vehicle to dive as explained, and depending upon the up, down, left or right maneuver desired, only one-quarter of the total ejection ring 16, 18, or 20 will be used. Another geometry, as shown in FIG. 4, requires that about twice the vehicle body 10 be covered with drag-reduction material 22 as compared to the arrangement of FIG. 3. In this arrangement the location of spaces between the ejector sections are located at the top, bottom, starboard and port sides of the vehicle body. To initiate a dive, the two top sections 24*a*, 24*d* will be activated and eject drag-reducing material 22 along essentially the top half of the vehicle body 10. This slight unbalancing of resistive forces will cause the vehicle body 10 to turn downwards in a diving direction. The arrangement shown in FIG. 5 includes eight ejection sections 24*a* through 24*h*. Selected ejection of the top four sections 24*a*, 24*b*, 24*g*, 24*h* will produce a dive. Selected ejection of the top most two sections 24*a*, 24*h* will also produce a dive but with less diving force than all four top sections distributing the drag reduction medium 22.

It will be understood that the arrangement of FIG. 5 is specific enough such that the top four sections 24*a*, 24*b*, 24*g*, 24*h* may be used to start a dive maneuver and subsequently only the top most sections 24*a*, 24*h* will be used to continue the diving maneuver. After the proper desired dive angle and/or the proper desire depth is reached, the sections will be controlled to end the maneuver. This ending of the dive may be done by slowing or stopping the ejection out of the upper sections, by ejecting drag-reducing fluid 22 out some or all of the bottom sections 24*d*, 24*e* (for example), or some combination and sequencing of ejections out of any or all of the sections 24*a* through 24*h*. It will be further understood that other numbers of ejection sections 24 may be used without departing from the spirit and scope of the invention.

Figure 6A:
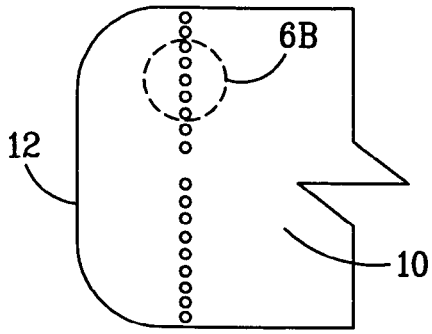
FIGS. 6A and 6B are a detail and exploded view, respectively, of a shape of ejection outlets for the present invention.
Figure 6B:
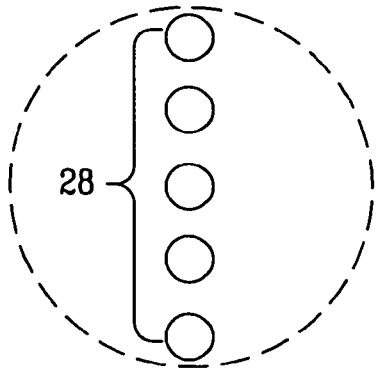
Figure 7A:
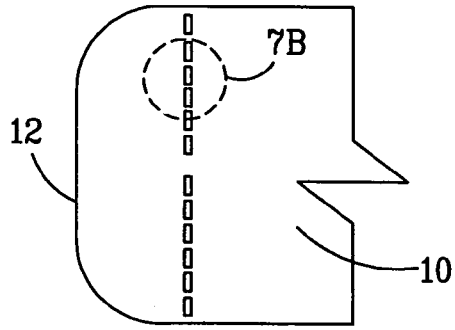
FIGS. 7A and 7B are a detail and an exploded view, respectively, of an alternative shape of ejection outlets for the present invention.
Figure 7B:
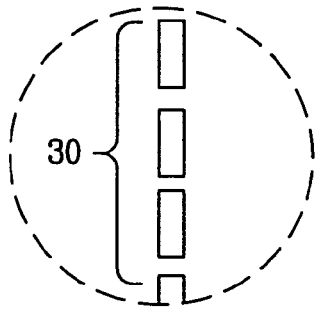
Figure 8A:
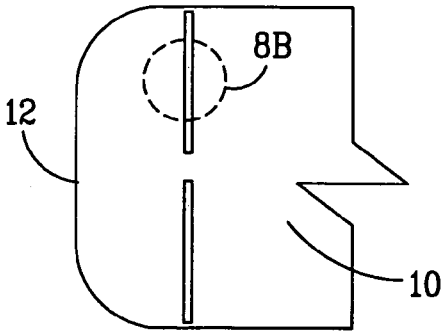
FIGS. 8A and 8B are a detail and an exploded view, respectively, of another shape of ejection outlets for the present invention.
Figure 8B:
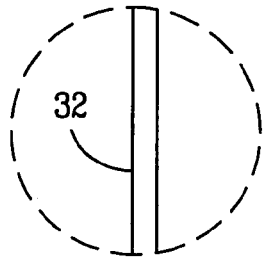

The ejection sections 24 may take different forms depending upon their intended use, the type or viscosity of drag reduction fluid used, or other related factors. For example, as shown in FIGS. 6A and 6B, each ejection section 24 may be formed of multiple circular openings 28 defining each section. Alternatively, as shown in FIGS. 7A and 7B, each section 24 may be formed of elongated slots 30. Further, as shown in FIGS. 8A and 8B, the ejection section 24 may itself be a single elongated slot 32. Depending upon the size of the vehicle, it is anticipated that as many as one hundred circular openings 28 or slots 30 may be used for each individual ejection section 24.

Figure 9A:
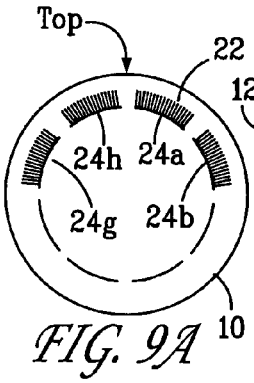
FIGS. 9A through 9I are sample ejection patterns of the present invention.
Figure 10:
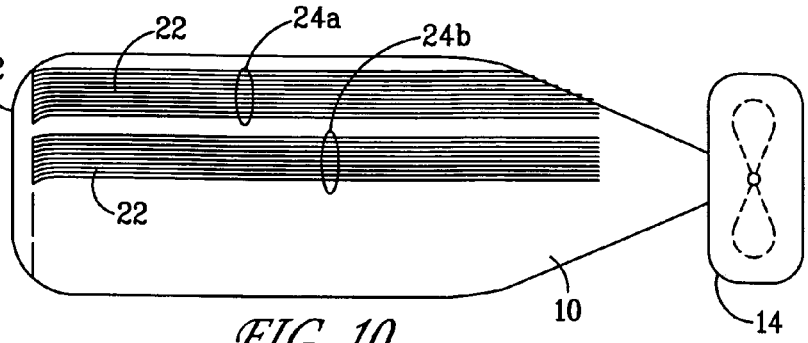
FIG. 10 is a side view of the underwater vehicle with an ejection from pattern 9A passing over the vehicle body.
Figure 9B:
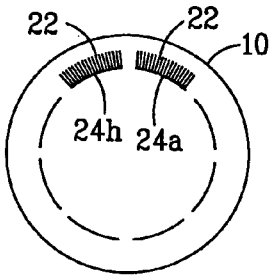
Figure 9C:
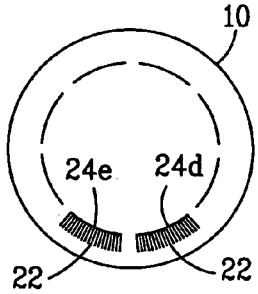
Figure 9D:
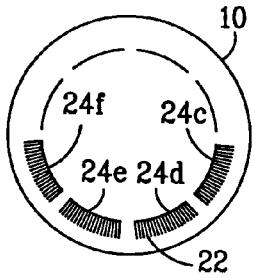
Figure 9E:
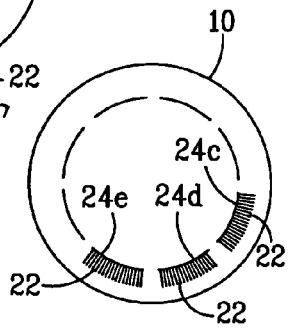
Figure 9F:
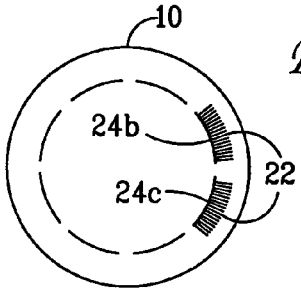
Figure 9G:
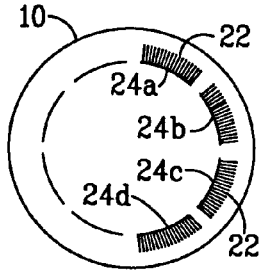
Figure 9H:
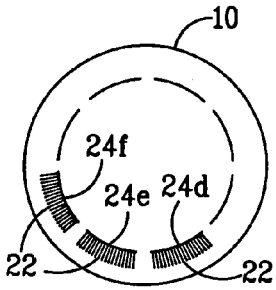

Turning now to FIGS. 9A through 9I, there are several illustrations of the possible combinations of operative ejector sections 24. In FIG. 9A, the drag-reduction fluid 22 is shown being ejected from the top four ejection sections 24*a*, 24*b*, 24*g*, 24*h*, thus facilitating the dive as discussed, FIG. 10 shows the possible appearance of the drag-reduction fluid 22 as it streams along the body surface of the vehicle 10. In FIG. 9B, only the top two ejector sections 24*a*, 24*h* are operative, thereby lessening the dive maneuver as compared to 9A. FIGS. 9C and 9D show those sections 24*d*, 24*e* (FIG. 9C) or 24*c*, 24*d*, 24*e*, 24*f* (FIG. 9D) which will be activated for a climb operation of the vehicle 10. FIGS. 9A and 9B indicate a dive or downward pitch. FIGS. 9C and 9D indicate a climb or upward pitch. This invention is capable of pitch control. FIG. 9E will enable a turning climb to the direction opposite of the ejector sections 24*c*, 24*d*, 24*e*, FIG. 9H will enable a turning climb to the direction opposite of the ejector sections 24*d*, 24*e*, and 24*f*. FIGS. 9*f* and 9*g* show a turn to the side away from ejector sections 24*b*, 24*c* (FIG. 9F), and a harder turn with sections 24*a*, 24*b*, 24*c*, 24*d* (FIG. 9G). This invention is capable of yaw control. It is also capable of a combination of pitch and yaw control as indicated in FIGS. 9E and 9H. These ejection patterns shown are not intended to be limiting of the invention and any suitable ejection pattern, including maneuver 360' degree radiuses in both pitch and yaw may be performed to achieve a desired maneuver.

If the vehicle body 10 is significantly negatively or positively buoyant, there may be a need to configure the ejector sections 24 in a non-symmetrical way. If the body 10 is designed to turn in a non-symmetrical way, the sections 24 might do better with more than eight sections or the vehicle body itself may be configured non-symmetrically. This is similar to the concept of race cars being built non-symmetrically because they turn one way only around a track.

In fact, the un-symmetric drag reduction could help keep a negatively or positively buoyant body 10 going straight ahead.

If a body is long and slender, multiple ejection rings 16, 18, 20 down the length of the vehicle 10 may be used. For example, in FIG. 1, ring locations 16 and 18, both with the top two sections 24*a*, 24*h* in the arrangement of FIG. 5 being activated will cause a dive. Ring section 18 will restore drag reduction fluid 22 to the top of the vehicle 10, which due to the long distance from ring 16, has been overly dissolved to be effective.

There are several choices of where to locate the ejector rings 16, 18, 20. Some factors dictating these choices have been discussed. Other considerations for location of the ejector rings include body speed, body size, fluid media, and Reynolds number. The Reynolds number could change by an order of magnitude due to speed changes (particularly) and fluid medium change (to a lesser extent). Speed changes could occur during a run (during a particular firing of that body), or various speeds could be selected for various runs. Fluid medium changes which will impact Reynolds number calculations are due to density and viscosity changes, which result from a combination of salinity changes and temperature changes, which in turn result from a combination of horizontal location and vertical location (depth). Bodies that cover large speed ranges and operating conditions may use two slot locations to optimize the ejection point. So, at one Reynolds number, FIG. 2 ring location 16 might be used, and for other operating conditions, FIG. 2 ring location 18 might be preferred.

Figure 11A:
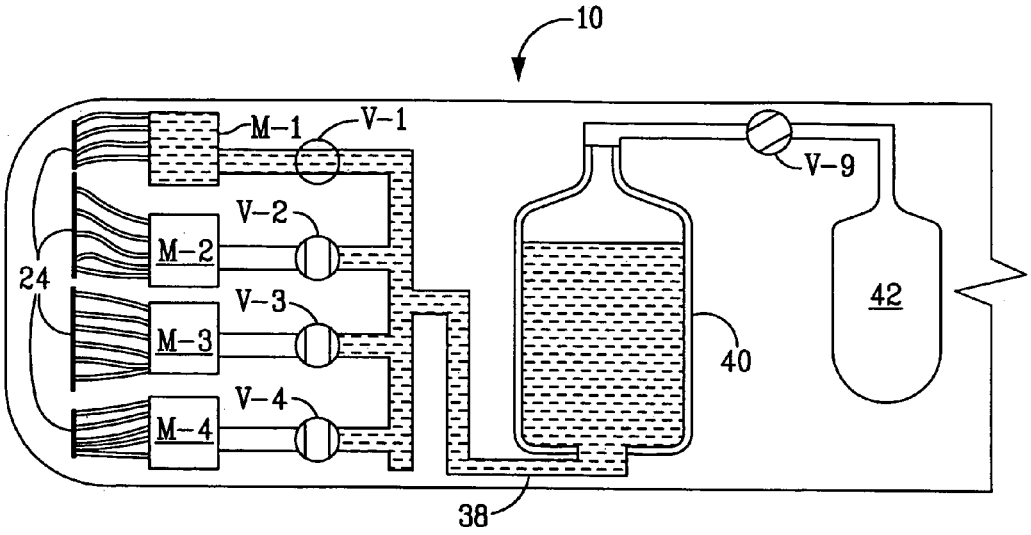
FIGS. 11A and 11B are schematic port and starboard views, respectively, showing a fluid dispensing arrangement for the present invention with an ejection from pattern 9B passing over the vehicle body.
Figure 11B:
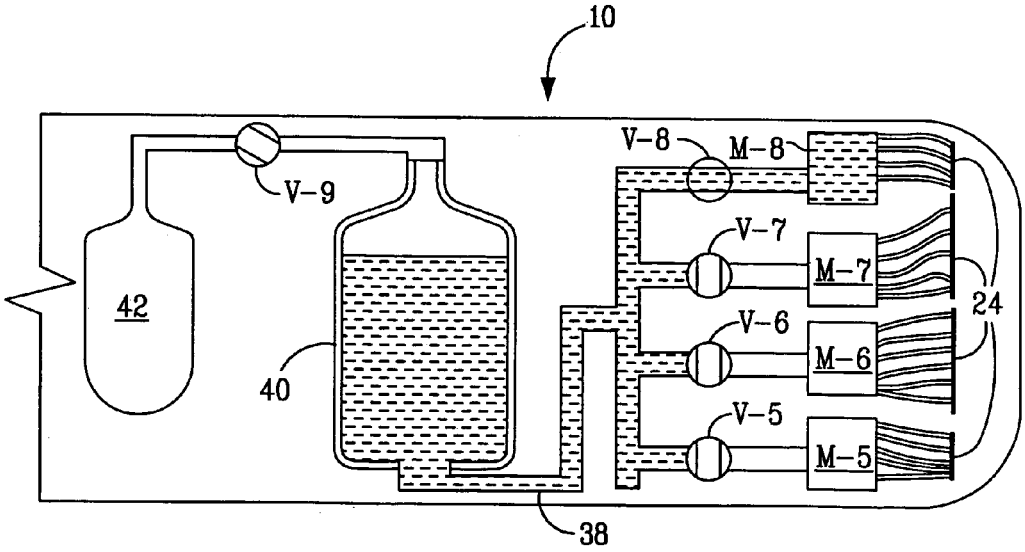
Figure 12:
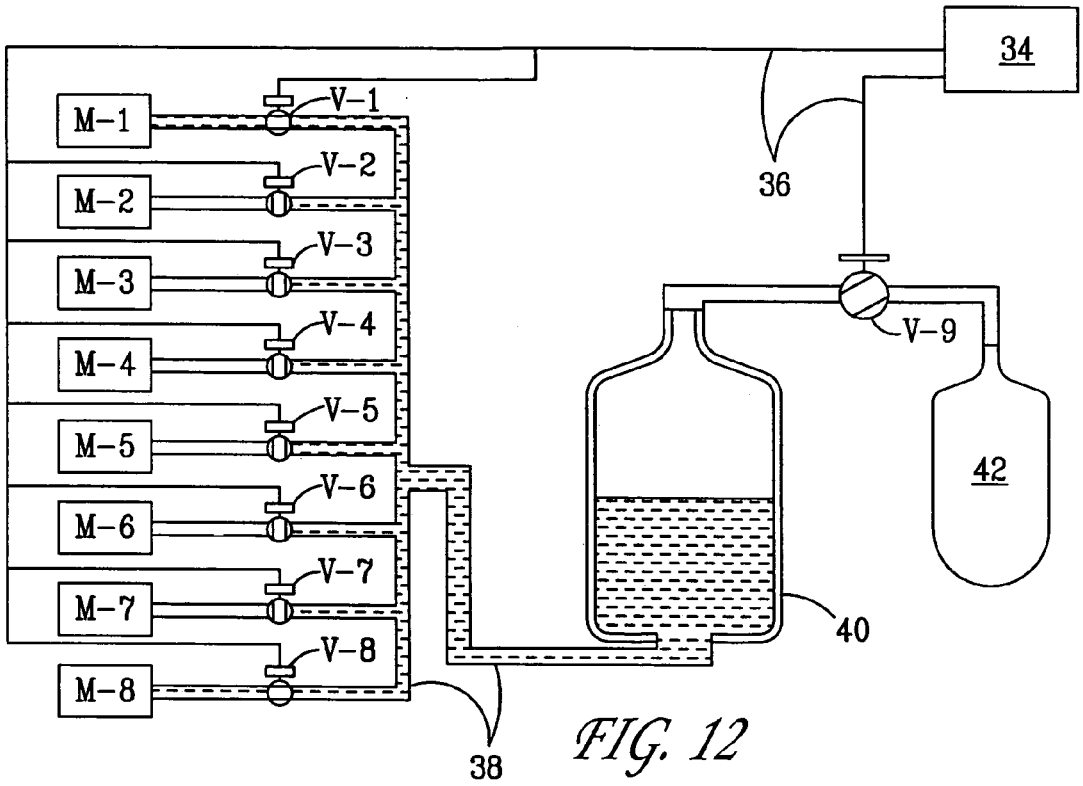
FIG. 12 is a schematic view showing an additional fluid dispensing arrangement for the present invention with an ejection from pattern 9B, as indicated by valve positions.
Figure 14:
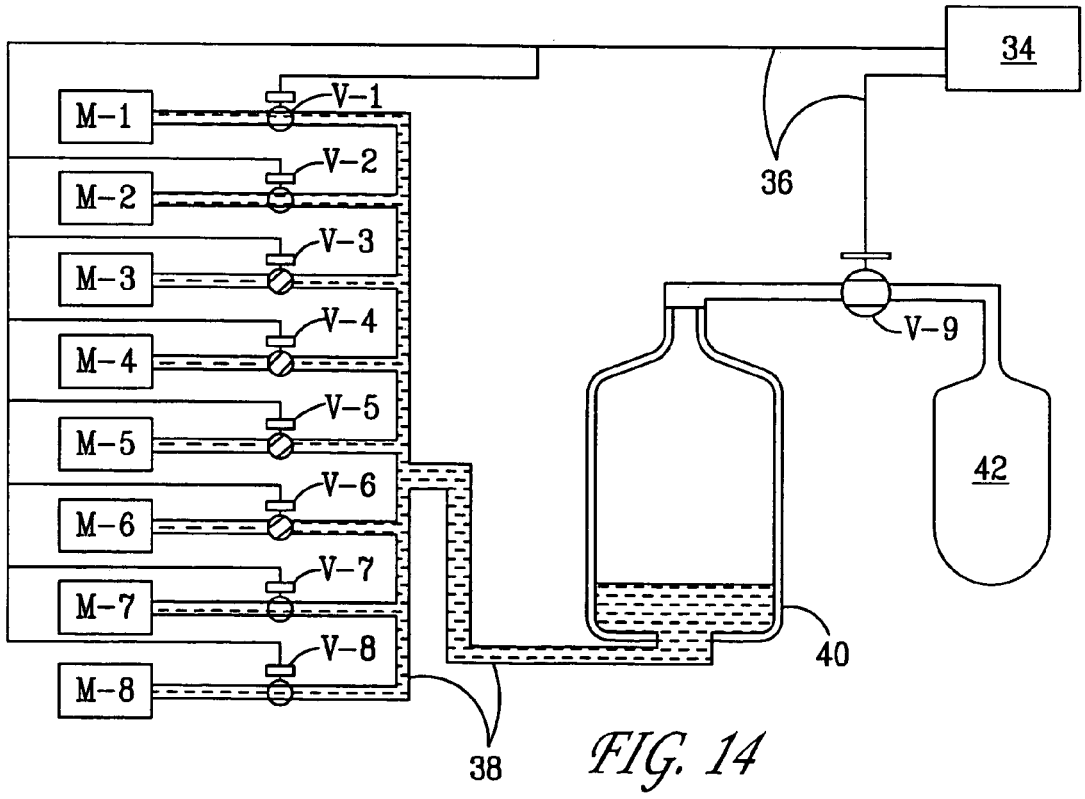
FIG. 14 is a schematic view showing an additional fluid dispensing arrangement for the present invention with an ejection pattern 9I, as indicated by valve positions.
Figure 13A:
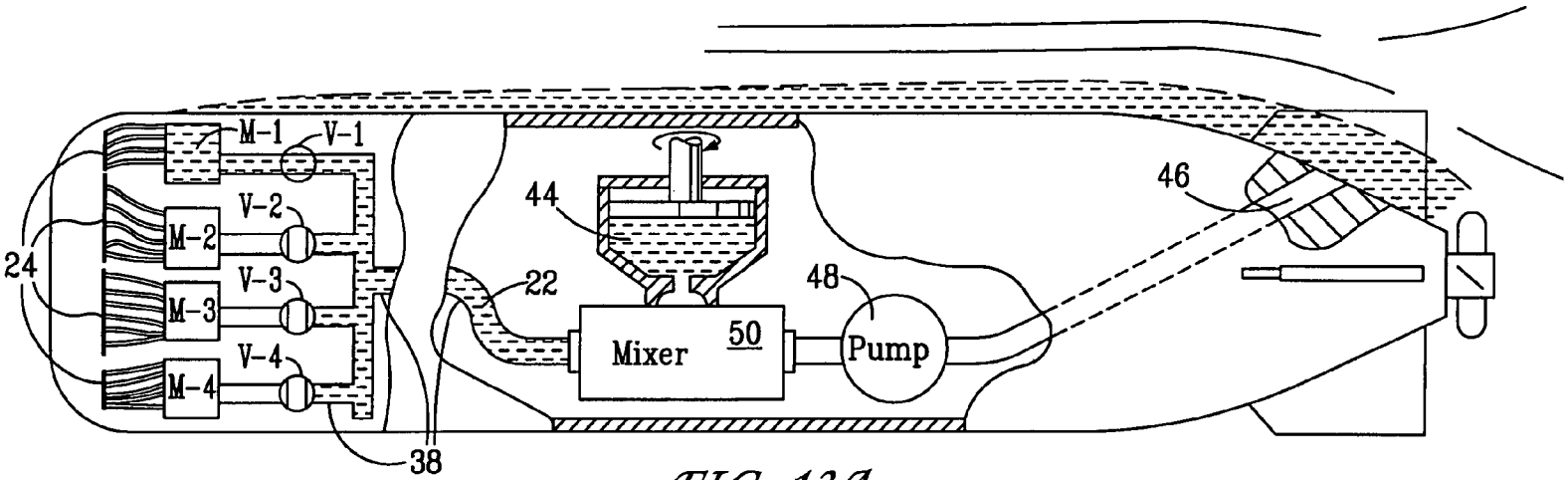
FIGS. 13A and 13B are port and starboard views, respectively, of a schematic view showing another fluid dispensing arrangement for the present invention with an ejection from pattern 9B passing over the vehicle body.
Figure 13B:
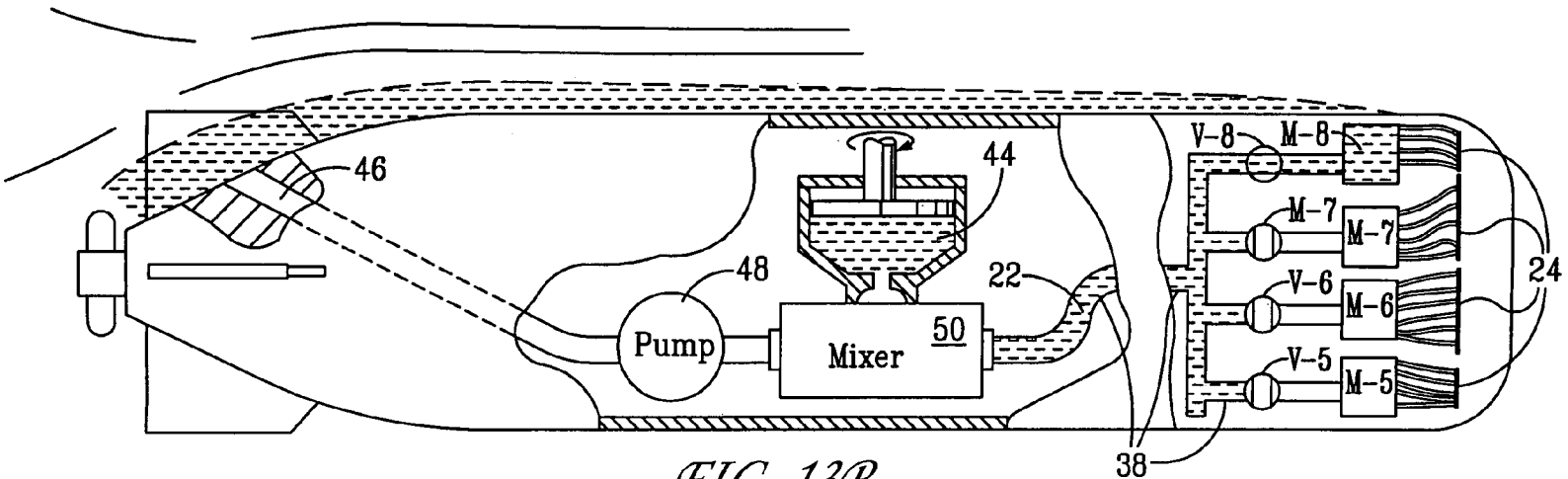

Referring now to FIGS. 11A, 11B, 12, 13A, 13B, and 14, each ejector ring 16, 18, 20 and each ejector section 24 in the ejector ring is controlled by a main control unit 34, and the actual mechanism for control are manifolds "M" and valves "V", connected by pipes as shown. One configuration for the valves and pipes and which may be used as the basis for virtually any configuration, is shown in FIGS. 11A and 11B. In FIG. 11A, elements M-1, M-2, M-3 and M-4 identify manifolds for the ejector sections 24*a*, 24*b*, 24*c*, 24*d*, respectively and valves V-1 through V-4 control the supply of drag-reducing fluid 22 to the respective manifolds. In FIG. 11B, elements M-5, M-6, M-7, and M-8 identify manifolds for the ejector sections 24*e*, 24*f*, 24*g*, and 24*h*, respectively, and valves V-5 through V-8 control the supply of drag-reducing fluid 22 to the respective manifolds. In FIG. 12, valves V-1 through V-8 control the supply of drag reducing fluid 22 to the manifolds M-1 through M-8, respectively. Wires 36 connecting the control unit 34 to the valves "V" are shown in FIG. 12. Pipes 38 from a drag-reduction fluid reservoir 40 to the valves "V" are shown in both FIGS. 11 and 12. The drag reduction fluid 22 may be force fed to the valves "V" and manifolds "M" as shown in FIGS. 11 and 12. This method is common in torpedoes that force process fluid through a plumbing system and is a pressure over liquid (POL) method. A ninth valve V-9 is used to control air pressure from a flask 42 over the drag-reduction fluid 22 in reservoir 40. In FIG. 11 the reservoir 40 is shown essentially full and in FIG. 12, the reservoir 40 is about half depleted.

For the schematics of FIGS. 11 and 12, valves V-1 and V-8 are open. Valves V-2 through V-7 are closed. Valve V-9 is also open. It should be noted that valve V-9 may be an on-off valve or a modulating valve so that the POL pressure can be modulated and controlled. Valves V-1 through V-8 may be on-off valves or modulating valves. This arrangement of valves allows drag-reduction fluid 22 to be ejected from the ejector sections 24 forming the top most sections. As previously explained, an ejection from the top two ejector sections 24 will initiate a dive maneuver for the vehicle 10.

In addition to the basic arrangement shown in FIGS. 11 and 12, it will be appreciated that a feedback may be used to determine whether the commanded heading, depth, or other desired result has been achieved. Specific vehicle features such as body length, weight, hydrodynamic aspects, center of gravity, center of buoyancy, and the like will all have an impact on the control of the vehicle 10.

Although the POL method of supplying drag reduction fluid is illustrated, it will be appreciated that other known methods of acquiring and supplying a drag-reduction fluid to a delivery system may be utilized in the present invention and are included in the scope of the invention. For example, a typical configuration is shown in FIG. 13 and involves a concentrated drag-reduction slurry supply 44 within the body of the vehicle that utilizes external seawater from an intake at 46 as a mixing element. The seawater passes through a pump 48 to a mixer 50 where the seawater is combined with the concentrated slurry to produce a desired concentration for drag-reduction fluid 22. The mixed drag-reducing fluid 22 is supplied to the drag-reduced steering arrangement as previously described. Proper activation and control of concentrated slurry supply 44, pump 48, and mixer 50, along with proper utilization of valves V-1 through V-8 and manifolds M-1 through M-8 will yield desired control and modulation of the ejected mixed slurry fluid 22 by controlling distribution of the slurry among the various sections in the various rings. This method effectively reduces the volume of slurry carried onboard a vehicle.

Figure 9I:
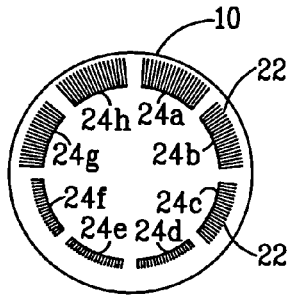

In addition to the segmented ejection slots being either fully activated (fully on) or fully off, one or more of them may be partially activated (partially on). FIG. 9I depicts a flow patterns wherein the lower four slots (24*c*, 24*d*, 24*e*, 24*f*) are activated but at a reduced level, and the upper four slots (24*a*, 24*b*, 24*g*, 24*h*) are fully activated (fully on). For example in FIG. 9I, the drag-reduction fluid 22 coming out of 24*c* would be approximately half of the fluid 22 coming out of 24*b*. This flow pattern could be created by controlling the valves in FIG. 14 as follows: valves V-1, V-2, V-7, and V-8 are fully opened; valves V-3, V-4, V-5, and V-6 are approximately half opened. Such a flow pattern would be advantageous near the latter portions of a vehicle run wherein the vehicle has become lighter due to consumption of fuel or even consumption of drag-reduction slurry. Note in FIG. 14, the reservoir 40 is shown essentially three-quarters depleted.

Accordingly, the present invention is a new and advantageous steering system for underwater vehicles, enabling an increased speed with reduced power requirements due to the reduction in external components for the underwater vehicle. The steering device is fully integrated within the body of the vehicle, thereby maintaining an outward streamlined shape. This configuration facilitates high velocity, low drag, and low noise flow over the vehicle body.

In view of the above detailed description, it is anticipated that the invention herein will have far reaching applications other than those of underwater steering.

This invention has been disclosed in terms of certain embodiments. It will be apparent that many modifications can be made to the disclosed apparatus without departing from the invention. Therefore, it is the intent of the appended claims to cover all such variations and modifications as come within the true spirit and scope of this invention.

What is claimed is:

1. A steering system for a hydrodynamically shaped vehicle having a nose end, a tail end, and forward propulsion, said steering system comprising:

an internal supply of drag-reducing medium;

at least one ejector ring positioned adjacent a nose end of said vehicle;

a plurality of ejector sections formed in said at least one ejector ring, each ejector section including an opening arrangement for ejecting drag-reducing medium to an external surface of said vehicle; and control means for selectively supplying said drag-reducing medium to at least one of said plurality of ejector sections, said drag-reducing medium ejected from selected ejector sections causing a reduced-drag surface on said vehicle body and an increased speed thereof relative to a remainder of said vehicle body and thereby imparting a directional motion to said body.

2. The apparatus according to claim 1 wherein two ejector rings are positioned on said vehicle, a first ejector ring positioned adjacent the nose of said vehicle and the second ejector ring positioned aft of said first ejector ring.

3. The apparatus according to claim 1 wherein three ejector rings are positioned on said vehicle, a first ejector ring positioned adjacent the nose end of said vehicle, the third ejector ring positioned adjacent the tail end of said vehicle, and the second ejector ring positioned between said first and third ejector rings.

4. The apparatus according to claim 1 wherein said plurality of ejector sections includes four ejector sections for at least one of said ejector rings, said ejector sections being evenly spaced around a circumference of said vehicle.

5. The apparatus according to claim 4 wherein said four ejector sections are positioned relatively at a top, bottom, starboard, and port of said vehicle body.

6. The apparatus according to claim 5 wherein said control means controls the distribution of said drag-reducing medium among said four ejectors sections for at least one of said ejector rings to impart a selected steering maneuvers to the vehicle of the group of maneuver consisting of a dive, a climb, a left turn, and a right turn.

7. The apparatus according to claim 4 wherein said four ejector sections are positioned such that the locations of the space between adjacent sections are positioned relatively at a top, bottom, starboard, and port of said vehicle body.

8. The apparatus according to claim 1 wherein said plurality of ejector sections includes eight ejector sections for at least one of said ejector rings, said ejector sections being evenly spaced around a circumference of said vehicle.

9. The apparatus according to claim 8 wherein said control means controls distribution supply of said drag-reducing medium among said ejector sections of said ejector rings to impart any steering maneuver to the vehicle within 360 degree radiuses in both pitch and yaw.

10. The apparatus according to claim 1 wherein the opening arrangement for said ejector sections includes a plurality of circular openings formed within each section.

11. The apparatus according to claim 1 wherein the opening arrangement for said ejector sections includes a plurality of slotted openings formed within each section.

12. The apparatus according to claim 1 wherein the opening arrangement for said ejector sections includes a single slot opening formed within each section.

13. The apparatus according to claim 1 wherein said drag reducing medium is a drag-reducing polymer-mixture.

14. The apparatus according to claim 1 wherein said control means controls the distribution of said drag-reducing medium among the ejector sections of said at least one ejector ring to impart a desired pitch and yaw steering maneuvers to the vehicle.

* * * * *